US006281418B1

(12) United States Patent
Chang

(10) Patent No.: US 6,281,418 B1
(45) Date of Patent: Aug. 28, 2001

(54) SPRING HANGING BLOCK FOR THE PEDAL MECHANISM OF A BASE DRUM

(75) Inventor: Jung Pin Chang, Taipei (TW)

(73) Assignee: New Sound Enterprise & Musical Instrument MFG Co. Ltd.

( * ) Notice: Subject to any disclaimer, the term of this patent is extended or adjusted under 35 U.S.C. 154(b) by 0 days.

(21) Appl. No.: 09/698,253

(22) Filed: Oct. 30, 2000

(51) Int. Cl.[7] ..... G10D 13/02

(52) U.S. Cl. ..... 84/422.1; 84/422.2; 84/422.3

(58) Field of Search ..... 84/422.1, 422.2, 84/422.3

(56) References Cited

U.S. PATENT DOCUMENTS

| | | | | |
|---|---|---|---|---|
| 4,756,224 | * | 7/1988 | Lombardi | 84/422.1 |
| 5,365,824 | * | 11/1994 | Hoshino | 84/422.1 |
| 6,002,076 | * | 12/1999 | Karn | 84/422.1 |
| 6,137,040 | * | 10/2000 | Hoshino | 84/422.1 |

* cited by examiner

*Primary Examiner*—Shih-Yung Hsieh
(74) *Attorney, Agent, or Firm*—A & J

(57) ABSTRACT

A spring hanging block injection-molded from plastics and coupled to a coupling rod of an end block of a pedal mechanism for base drum to suspend a tensile spring, having a coupling hole with positioning structure configured for fastening to the coupling rod of the end block of the pedal mechanism, a pin hole adapted to hold a rivet, and an end notch through which the tensile spring is inserted and hooked on the rivet.

1 Claim, 5 Drawing Sheets

PRIOR ART

SPRING HANGING BLOCK FOR THE PEDAL MECHANISM OF A BASE DRUM

BACKGROUND OF THE INVENTION

1. Field of the Invention

The present invention relates to a pedal mechanism for base drum, and more particularly to a spring hanging block adapted for use in a pedal mechanism for base drum, which is injection-molded from plastics.

2. Description of the Prior Art

A regular pedal mechanism for base drum, as shown in FIGS. 2 and 2A, comprises a stand 1, a transverse shaft 3 supported on the stand 1 by axle bearings 4, a beater 5 connected to the transverse shaft 3 and turned back and forth with the transverse shaft 3, a pedal 2, the pedal 2 having a rear end pivoted to the stand 1 and a front end coupled to the transverse shaft 3 by a chain, an end block 61 fixedly fastened to one end of the transverse shaft 3, the end block 61 having, a coupling, rod 61 1, a nut 65 fixedly fastened to the stand 1, an eye-end screw 64 fastened to the nut 65, a spring hanging block 62 coupled to the coupling rod 611 of the end block 61, and a tensile spring 63 connected between the spring hanging block 62 and the eye-end screw 64. The spring hanging block 62, as shown in FIG. 1, is comprised of two half shells fastened together by a screw 66, comprising a coupling hole 621 adapted to receive the coupling rod 611 of the end block 61, a positioning groove 622 and a positioning flange 623 adapted to secure the coupling rod 611 to the coupling hole 621, and a bottom hook 624 adapted to hold the tensile spring 63. Because this structure of spring hanging block is comprised of two half shells that are not identical, the manufacturing cost of the spring hanging block is high, and its installation procedure is complicated. This structure of spring hanging block also complicates inventory control.

SUMMARY OF THE INVENTION

The present invention relates to a pedal mechanism for base drum, and more particularly to a spring hanging block adapted for use in a pedal mechanism for base drum, which is injection-molded from plastics.

The invention has been accomplished to provide a spring hanging block, which eliminates the aforesaid drawbacks. It is one object of the present invention to provide a spring hanging block, which is inexpensive to manufacture. It is another object of the present invention to provide a spring hanging block, which is easy to install. According to one aspect of the present invention, the spring hanging block comprises a coupling hole with positioning means adapted for fastening to the coupling rod of the end block of the pedal mechanism, a pin hole adapted to hold a rivet, and an end notch through which the tensile spring is inserted and hooked on the rivet.

According to another aspect of the present invention, the spring hanging block is injection-molded from plastics.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
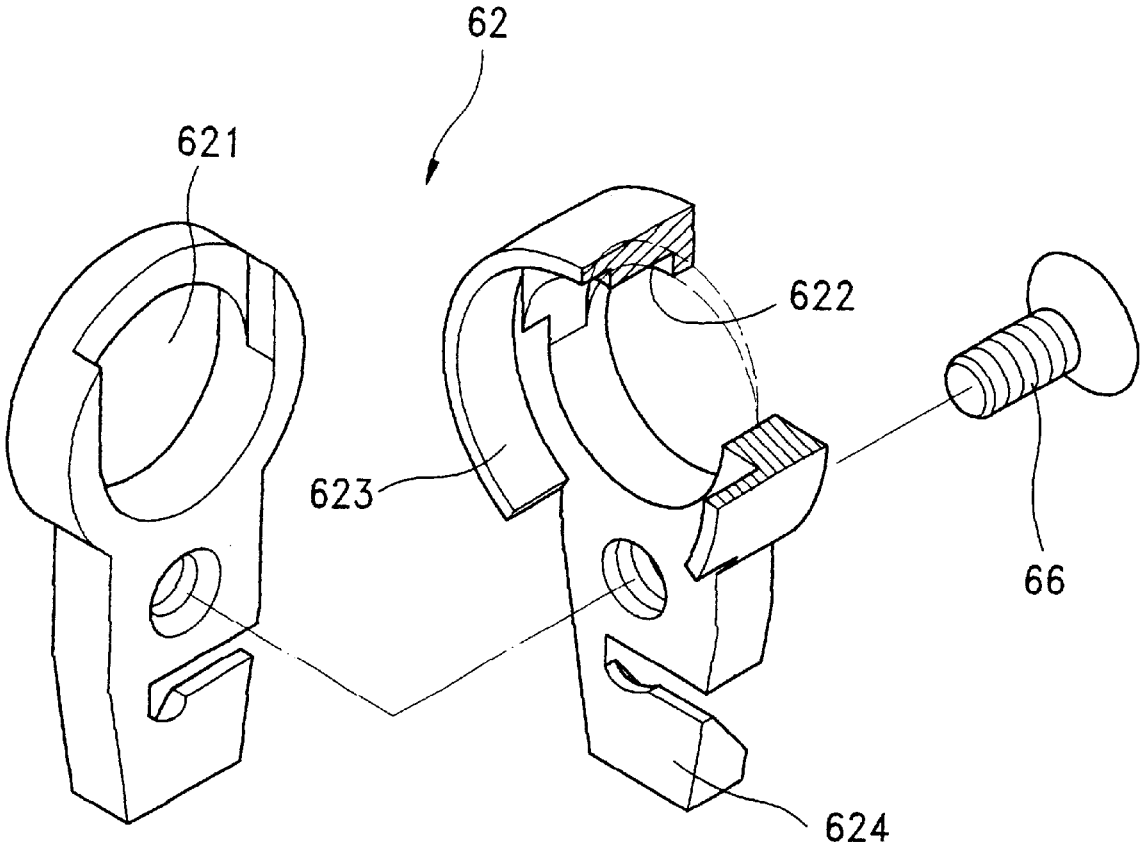
PRIOR ART FIG. 1
FIG. 1 is an exploded view of a spring hanging block for a pedal mechanism for base drum according to the prior art.
Figures 2, 2A:
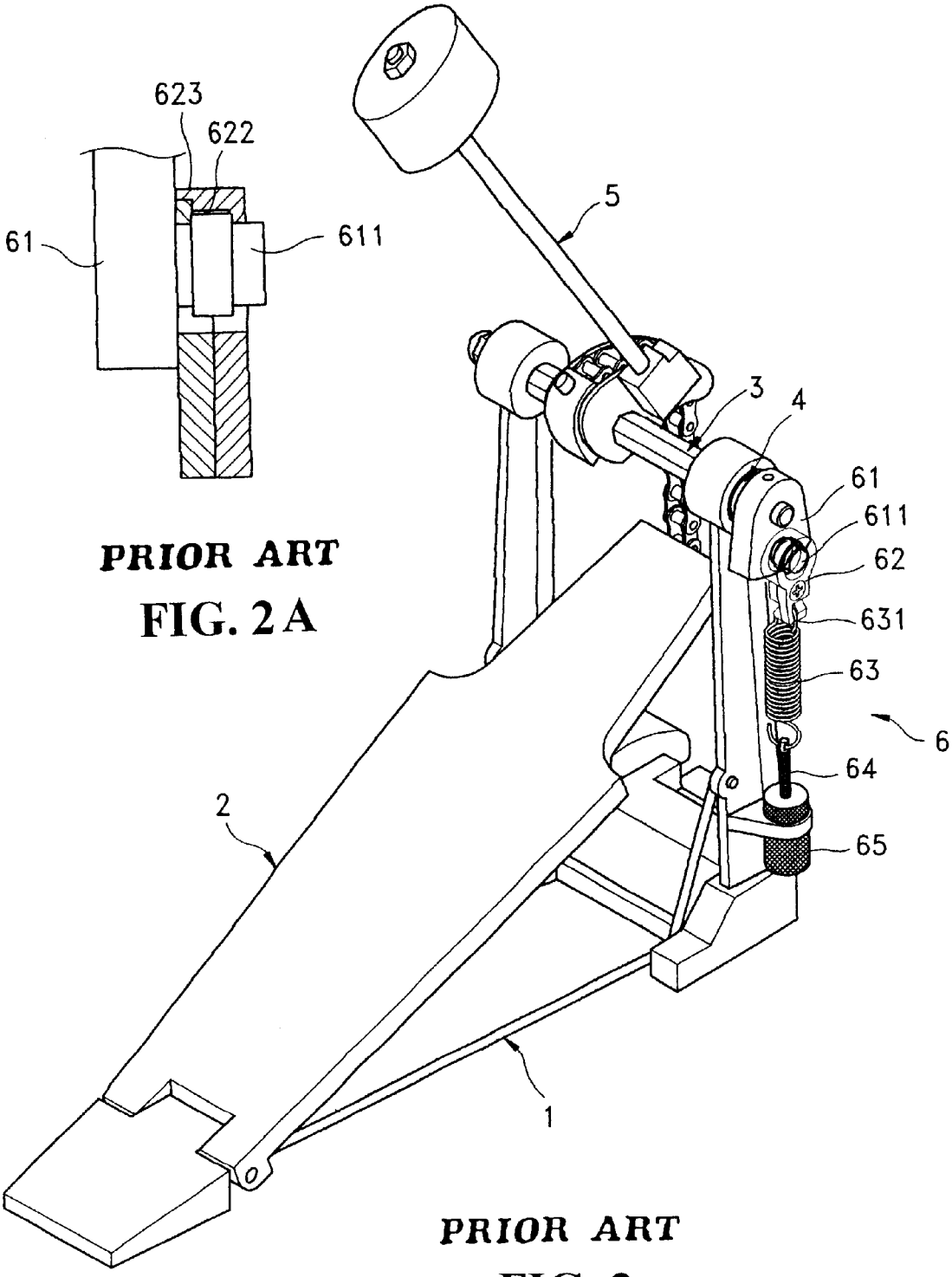
FIG. 2A PRIOR ART
FIG. 2 is a perspective view of a pedal mechanism for base drum according to the prior art, showing the spring hanging block connected between the coupling rod of the end block and the tensile spring.
FIG. 2A is a sectional view in an enlarged scale of a part of FIG. 2.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Referring to FIGS. 4A, 4B, 4C, 4D, 5 and 5A, a spring hanging block 7 is coupled to the coupling rod 611 of an end block 61 in a pedal mechanism 6 for base drum (not shown). The spring hanging block 7 is injection-molded from plastics, comprising a coupling hole 71 transversely disposed near one end thereof and adapted to receive the coupling rod 611 of the end block 61, a protruded stop portion 72 disposed at one side of the coupling hole 71 and adapted to stop the coupling rod 611 of the end block 61 in the coupling hole 71, two crescent-like flanges 73 disposed at the other side of the coupling hole 71, a gap 74 defined between the crescent-like flanges 73 for the passing of the coupling rod 611 of the end block 61, a positioning groove 75 defined inside the coupling hole 71 between the protruded stop portion 72 and the crescent-like flanges 73 for the positioning of the coupling rod 611 of the end block 61, a pin hole 77 transversely disposed near the other end thereof and adapted to hold a rivet 76, and an end notch 78 disposed across the pin hole 77 through which one hooked end 631 of the tensile spring 63 of the pedal mechanism 6 is inserted and hooked on the rivet 76 being installed in the pin hole 77.

Figure 3:
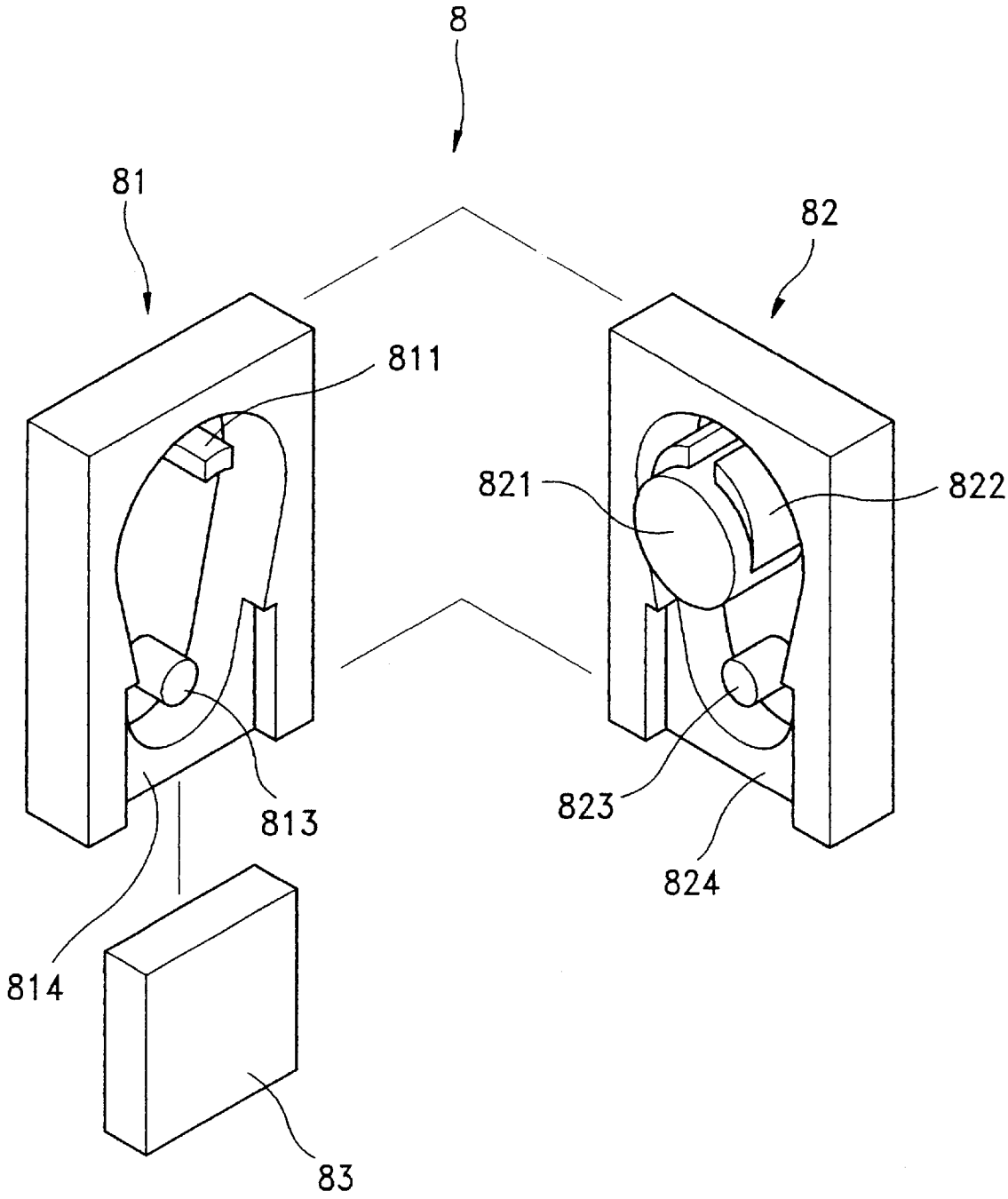
FIG. 3 is an exploded view of a mold for molding spring hanging block according to the present invention.
Figure 4A:
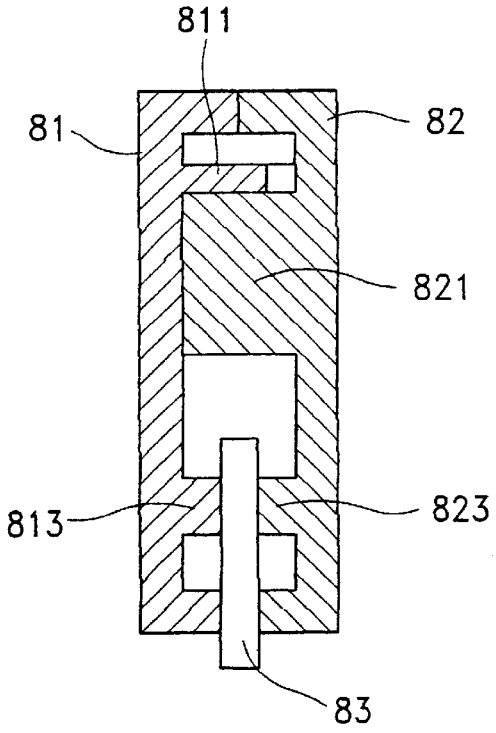
FIG. 4A is a sectional view of the mold for molding spring hanging block according to the present invention.
Figure 4B:
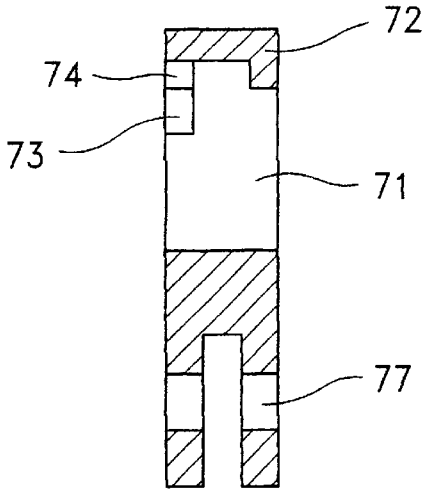
FIG. 4B is a sectional view of the spring hanging block according to the present invention.
Figure 4C:
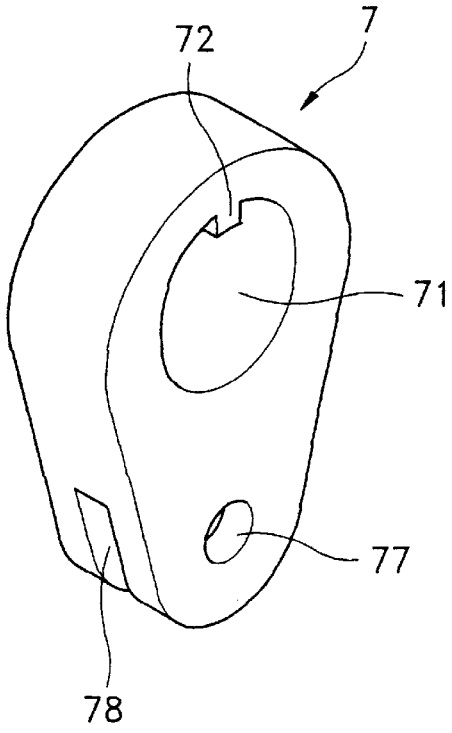
FIG. 4C is an oblique side elevation of the spring hanging block according to the present invention.
Figure 4D:
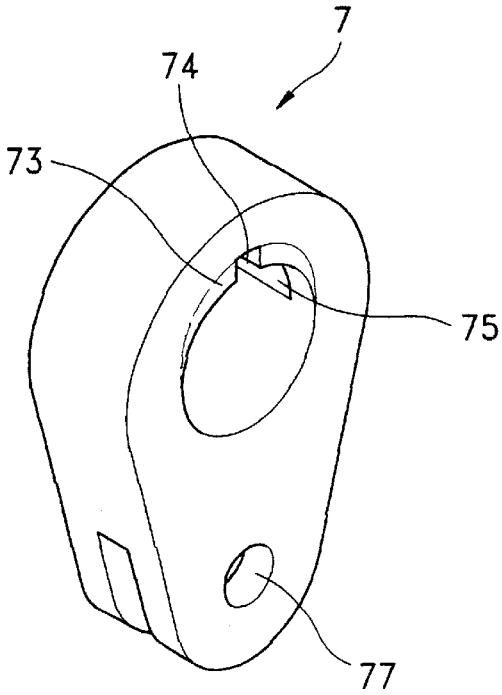
FIG. 4D is another oblique side elevation of the spring hanging block according to the present invention when viewed from another side.
Figures 5, 5A:
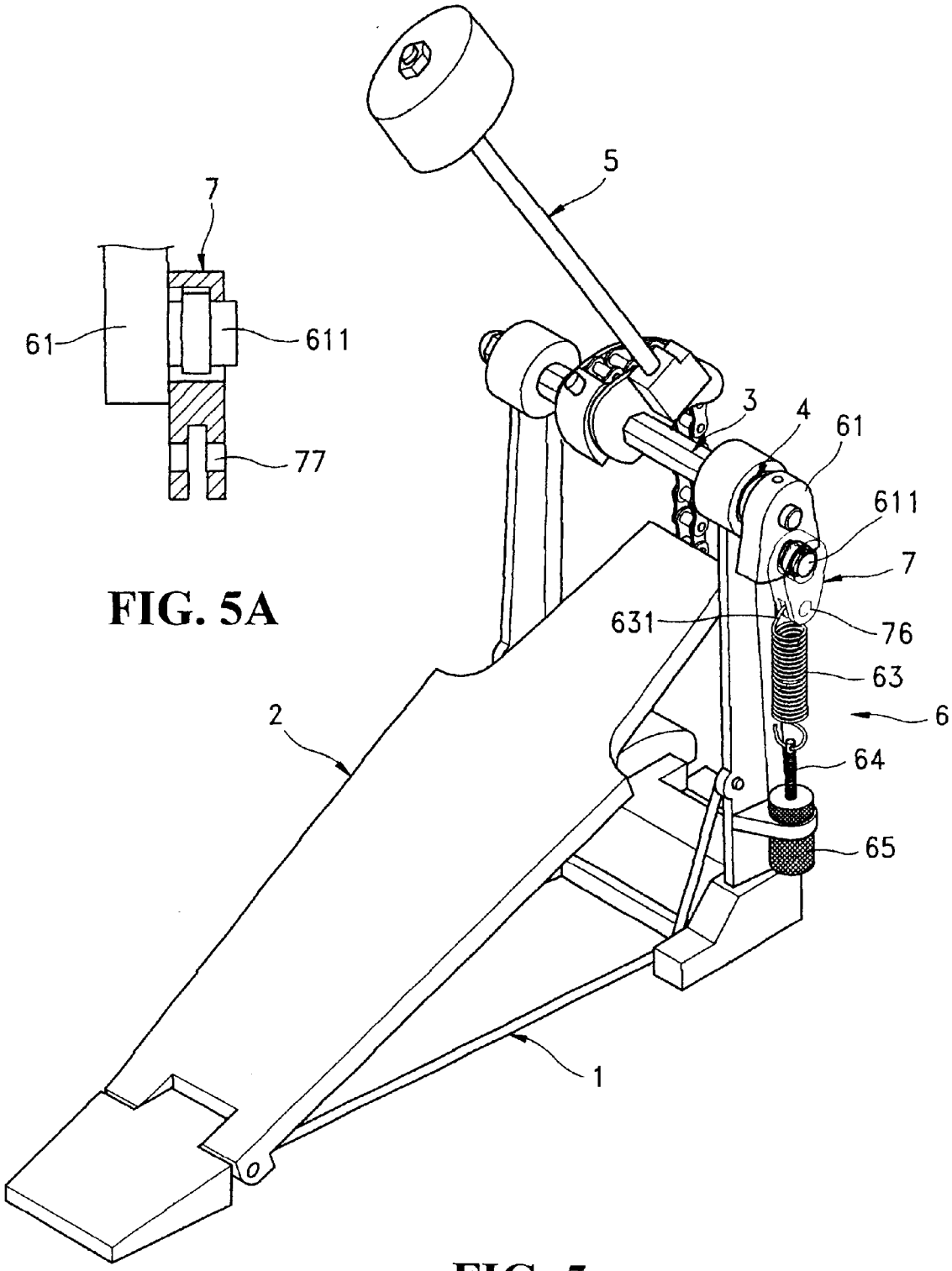
FIG. 5 is an applied view of the present invention, showing the spring hanging block connected between the coupling rod of the end block and the tensile spring.
FIG. 5A is a sectional view in an enlarged scale of a part of FIG. 5.

Referring to FIG. 3, a mold 8 for molding the aforesaid spring hanging block 7 is shown comprised of a female die 81, a male die 82, and an insert 83. The female die 81 comprises a rectangular block 811 and a round rod 813 suspended in the cavity thereof near two distal ends, and a recessed portion 814 extended from the cavity to one peripheral side thereof. The male die 82 comprises a round block 821 and a round rod 823 suspended in the cavity thereof near two distal ends, two crescent-like projections 822 suspended in the cavity adjacent to the periphery of the round block 821, and a recessed portion 824 extended from the cavity to one peripheral side thereof. When the male die 81 and the female die 82 are closed together, the insert 83 is inserted into the recessed portions 814 and 824 and retained between the round rods 813 and 823 for the formation of the aforesaid pin hole 77 and end notch 78, and the rectangular block 811 of the female die 81 matches with the round block 821 and crescent-like projections 822 of the male die 82 for the formation of the aforesaid protruded stop portion 72, crescent-like flanges 73, gap 74 and positioning groove 75.

It will be understood that each of the elements described above, or two or more together may also find a useful application in other types of methods differing from the type described above. While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A spring hanging block coupled to a coupling rod of an end block of a pedal mechanism for base drum and adapted to suspend a tensile spring, the spring hanging block comprising a coupling hole transversely disposed near one end thereof and adapted to receive the coupling rod of the end block a protruded stop portion disposed at one side of said coupling hole and adapted to stop the coupling rod of the end block in said coupling hole, two crescent-like flanges disposed at an opposite side of said coupling hole, a gap defined between said crescent-like flanges for the passing of the coupling rod of the end block, a positioning groove defined inside said coupling hole between said protruded stop portion and said crescent-like flanges for the positioning of the coupling rod of the end block, a pin hole transversely disposed near an opposite end thereof and adapted to hold a rivet, and an end notch disposed across said pin hole through which one hooked end of the tensile spring of the pedal mechanism is inserted and hooked on the rivet being installed in said pin hole.

* * * * *